US006692046B2

(12) United States Patent
Paskonis

(10) Patent No.: US 6,692,046 B2
(45) Date of Patent: Feb. 17, 2004

(54) LATCH STRIKER WITH INTEGRAL BACK PLATE

(75) Inventor: Almantas K. Paskonis, Concord, OH (US)

(73) Assignee: Anchor Tool & Die Company, Cleveland, OH (US)

( * ) Notice: Subject to any disclaimer, the term of this patent is extended or adjusted under 35 U.S.C. 154(b) by 0 days.

(21) Appl. No.: 10/016,431

(22) Filed: Dec. 10, 2001

(65) Prior Publication Data

US 2003/0107222 A1 Jun. 12, 2003

(51) Int. Cl.[7] ..... E05B 15/02

(52) U.S. Cl. ..... 292/340; 292/DIG. 64; 29/410

(58) Field of Search ..... 292/340, 341, 292/341.11, 341.12, 341.14, DIG. 64; 29/410, 524

(56) References Cited

U.S. PATENT DOCUMENTS

| | | | | | |
|---|---|---|---|---|---|
| 477,654 | A | * | 6/1892 | Grimes | |
| 849,865 | A | * | 4/1907 | Spencer | |
| 2,634,147 | A | * | 4/1953 | Robertson | 292/216 |
| 2,661,973 | A | * | 12/1953 | Sweger | 292/246 |
| 2,860,905 | A | * | 11/1958 | Wiese | 292/341.12 |
| 4,911,488 | A | | 3/1990 | Brackmann et al. | 292/216 |
| 4,998,759 | A | | 3/1991 | Peterson et al. | 292/340 |
| 5,125,698 | A | * | 6/1992 | Thau | 292/216 |
| 5,263,752 | A | | 11/1993 | Phail-Fausey et al. | 292/340 |
| 5,382,062 | A | | 1/1995 | Kostler | 292/340 |
| 5,501,495 | A | * | 3/1996 | Claucherty | 292/340 |
| 5,529,356 | A | | 6/1996 | Cetnar | 292/340 |
| 5,707,092 | A | | 1/1998 | Van Slembrouck et al. | 292/341.19 |
| 5,716,085 | A | | 2/1998 | Kobayashi | 292/340 |
| 5,755,468 | A | * | 5/1998 | Buchanan | 292/341.16 |
| 5,927,774 | A | * | 7/1999 | Granger | 292/340 |
| 6,073,980 | A | | 6/2000 | Arabia et al. | 292/340 |
| 6,095,576 | A | * | 8/2000 | Burton | 292/340 |
| 6,095,577 | A | * | 8/2000 | Nolzen | 292/340 |
| 6,106,037 | A | * | 8/2000 | Burton | 292/340 |

FOREIGN PATENT DOCUMENTS

| | | | |
|---|---|---|---|
| EP | 0667433 B1 | 5/1998 | E05B/15/02 |

* cited by examiner

*Primary Examiner*—Gary Estremsky
(74) *Attorney, Agent, or Firm*—Roetzel & Andress

(57) ABSTRACT

A striker assembly for latch engagement has symmetrical sides of three intersecting plates including a mounting plate, a striker plate in which a striker throat and striker bar is formed, and a back plate which intersects the mounting plate and striker plate. The back plate adds substantial structural strength to the striker and prevents consumption of the striker by the latch under severe overload conditions such as in a collision. A cap weld over the contact surface of the striker bar further increases strength and reduces friction with the engaging latch pawl. One piece and two piece embodiments are described, and in combination with overslam bumpers mounted on the back plates, and an insert piece in combination with the one piece embodiment.

20 Claims, 4 Drawing Sheets

LATCH STRIKER WITH INTEGRAL BACK PLATE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "MICROFICHE APPENDIX"

Not applicable.

BACKGROUND OF THE INVENTION (1) Field of the Invention

This invention relates generally to latch assemblies, and more particularly, to striker designs for use with latching mechanisms for vehicle doors or other applications.

(2) Description of the Related Art Including Information Disclosed under 37 CFR 1.97 and 37 CFR 1.98.

Motor vehicle door latching mechanisms typically include a handle or electro-mechanically operated latching mechanism mounted on the door, operative to engage a striker mounted on a door post. The latch and striker must remain engaged even under extremely high stress loads as produced by collisions. The National Highway Traffic Safety Administration, Department of Transportation promulgates the Federal Vehicle Safety standards such as Federal Vehicle Safety Standard number 206 covering door locks and door retention components including latches, hinges, and other supporting means, and specifies requirements to minimize the likelihood of occupants being thrown from the vehicle as a result of impact.

In certain types of motor vehicle collisions and crashes, the forces will cause the door to be jammed shut, such as by the swinging end of the door being compressed against the door post, jamming of the latch mechanism against the striker also contributes to the door being stuck in the closed position. This occurs, for example in unibody framed motor vehicles involved in a front or rear end collision. The collision may cause a shortening of the vehicle frame which results in the door striker being forced into the door edge where the latch is mounted, so that the door latch surrounds and is trapped by the door striker, or the lock becomes consumed by the door. In sideways collisions, the door may be extruded behind the door striker by the force of the collision. As a result, the occupants may be trapped inside the vehicle. Injured occupants may not receive necessary or timely medical attention until the door is removed. In the case of an accident where a gasoline line is ruptured or other hazardous material is spilled in the vicinity, an occupant trapped in the vehicle may be exposed to life threatening conditions and be unable to escape.

Certain types of strikers are particularly susceptible to being jammed upon impact. Single bolt style strikers have been widely employed but have been found to be not as strong as stamped designs fastened at two points to the door post. U-bolt style strikers have been widely used, but are prone to trapping a portion of the latch under collision loads. Another striker design used in the industry was a J shaped striker which was bolt mounted to the door post. The J shaped striker was also prone to jamming with the latch mechanism and has only a single fastening point to the door post.

Another striker design is disclosed in U.S. Pat. No. 5,501,495 to Claucherty. This striker is comprised of a pair of individually formed, matched, symmetrical plates. The plates are attached by a spot weld. Additionally, the interior faces of the plates may be brazened. The latch retaining strength of this striker is primarily in the plane of attachment to the door post, and is particularly dependent upon the weld which holds the two halves together. Because the upstanding position of the striker which the latch engages is in a single plane, the striker is consumed by the latch under the compressive force of a collision. This makes it much more difficult to disengage the latch in crash recover. Also, rough edges of the stamped pieces which are welded together do not provide a smooth latching surface for engagement of the latch pawl, resulting in a more difficult operation of the latch.

A need therefore exists for a door striker which provides increased probability of surviving an impact or collision, preferably providing protection in three orthogonal planes and not requiring any welds which may mar the exposed surfaces.

Additional objects, advantages and novel features of the invention will be set forth in part in the description which follows, and in part will become apparent to those skilled in the art upon examination of the following or may be learned by practice of the invention. The objects and advantages of the invention may be realized and attained by various structures as covered by the patent claims.

BRIEF SUMMARY OF THE INVENTION

In one embodiment, the invention is a striker assembly comprised of a pair of symmetrically arranged three-plane pieces, including a mounting plate, a striker plate and a back plate. In an alternate embodiment, a symmetrical three-plane striker assembly is formed from a single piece of sheet steel. In the two-piece embodiment, each piece includes a mounting plate, a striker plate including a striker bar and a latch-receiving aperture or throat, and a reinforcing back plate. The mounting plate is configured for mounting the striker assembly to a door post or similar structure. The striker plate has an interior face and an exterior face, and is generally orthogonal to the mounting plate. The striker and mounting plates intersect at generally 90 degrees, and the back plate is generally orthogonal to the mounting and striker plates. In the assembly, the interior faces of the striker plates are placed in surface to surface contact to form a double thickness striker plate and striker bar. The back plate of each piece is generally orthogonal to the mounting and the striker plates. The back plate extends from the mounting plate and is bent along an axis transverse to the mounting plate so that one edge of the back plate intersects the edge of the striker plate opposite the striker bar. The intersecting edge of the back plate may be welded or brazed to the striker plate. The back plate reinforces the entire striker assembly, and prevents the striker assembly from being consumed by the latch in a crash.

Another important aspect of the invention is a cap weld at the contact face of the striker bar. The cap weld bonds the frontal seam of the two striker plates at the striker bar, and provides a smooth radiused surface which facilitates engagement of the latch pawl about the striker bar. In an alternate embodiment, the striker assembly may be comprised of a single stamped piece of sheet steel.

Among the benefits and improvements that have been disclosed, other objects and advantages of this invention will become apparent from the following description made with reference to the accompanying drawings. The drawings constitute a part of this specification and include exemplary embodiments, and illustrate various objects, features, attributes and mechanical advantages of the invention.

BRIEF DESCRIPTION OF THE FIGURES

The drawings illustrate the best mode presently contemplated of carrying out the invention.

This the drawings.

DETAILED DESCRIPTION OF PREFERRED AND ALTERNATE EMBODIMENTS OF THE INVENTION

Figure 1:
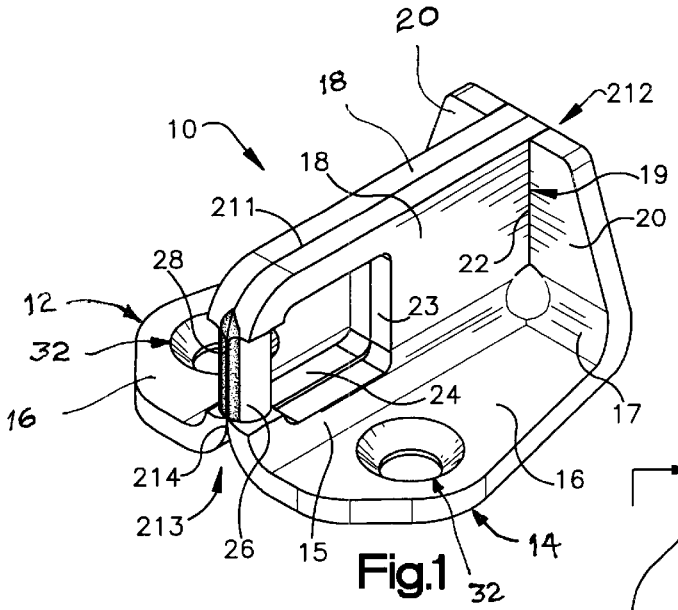
FIG. 1 is a perspective view of a striker assembly constructed according to the present invention.
Figure 2:
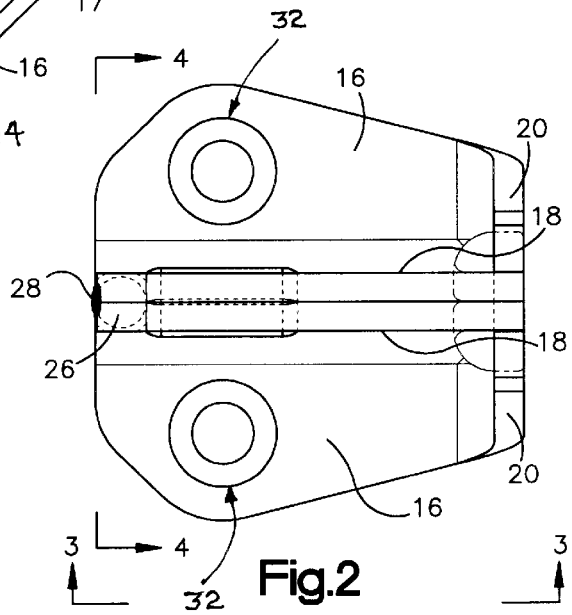
FIG. 2 is a plan view of the striker assembly of FIG. 1.
Figure 4:
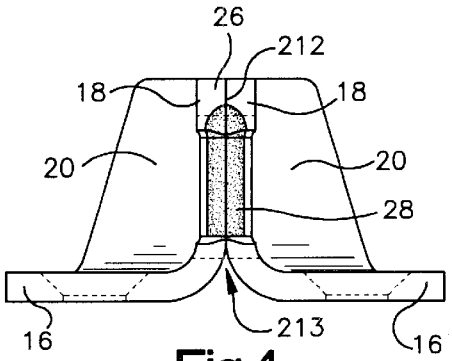
FIG. 4 is an elevation of the striker assembly of FIG. 1.
Figure 3:
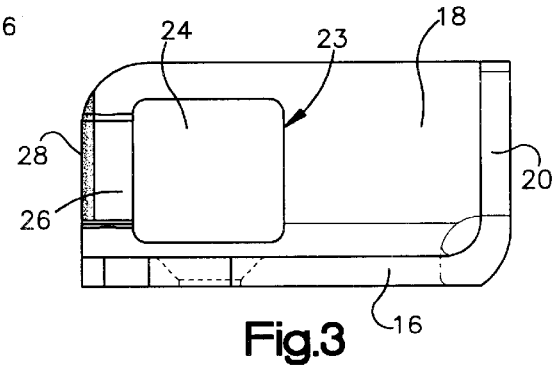
FIG. 3 is a profile view of the striker assembly of FIG. 1.

Referring now to FIG. 1, a latch striker assembly embodying the principles of the present invention is generally illustrated therein and designated at 10. As illustrated in FIG. 1, the striker assembly 10 configured to be mounted to a door post P or other body frame member. The striker assembly 10 is designed to operate with a latching or locking mechanism mounted within or on a vehicle door, as further described in connection with FIGS. 5–7. Typically, the locking mechanism includes a pawl or locking lever that is exposed through an opening in the latch body, also referred to as the "fish mouth". As the automobile door is closed, a striker bar of the striker assembly, as further described below, enters the latch body through the fish mouth and is engaged by the latch pawl.

In one embodiment, as shown in FIG. 1, the striker assembly 10 is composed of two generally symmetrical contoured pieces 12 and 14 fixedly secured together. Symmetrical pieces 12 and 14 are each preferably formed as individual steel stampings, bent along lines 15 and 17, and intersecting along line 19, to form three intersecting plates 16, 18 and 20. Plate 16 is referred to as the mounting plate. Plate 18 is referred to as the striker plate. Plate 20 is referred to as the back plate or backing plate. The pieces 12 and 14 are arranged together by back-to-back alignment of the striker plates 18 as shown to form the striker assembly 10. This creates a seam about the perimeter of striker plates 18, which has four segments 211, 212, 213 and 214. To structurally bond the two pieces 12 and 14 together, welds can be made along seam segments 212 and 214. Although not structurally necessary, bondings or welds can also be made along seam segments 211 and 213. The intersection of back plates 20 with striker plates 18 creates seams 22, along which bonding welds can also be made.

The described bonding welds can be TIG or plasma welds as known in the art. Where structural welds are not made along seams 212 or 214, the seam can be brazed for two purposes. One, brazing along the seams serves to temporarily bond pieces 12 and 14 together as the pieces are transported through heat treatment. And two, brazing along the seams and migration of the braze material between the facing surfaces of the striker plates 18 by capillary action creates a barrier to moisture entering between the pieces and resultant corrosion. Brazing can be applied in an atmospheric chamber which promotes migration of the braze material by capillary action between contact surfaces.

Each of the striker plates 18 includes a cut-out perimeter 23 which defines an opening 24 also referred to as the striker throat, adjacent to a striker bar 26 which is configured to be engaged by a latch pawl. Seam 214 runs along the latch pawl contact area of the striker bar 26. The striker bar 26 can be straight as shown, or curvilinear, such as arcing outward or inward relative to the plates, to optimize mating with any particular latch. A special cap weld 28 is formed along seam 214 which provides a smooth continuous and radiused surface with which the latch pawl comes into rotational contact upon engagement. Preferably, the cap weld 28 is formed by pooling of the weld flux material between the aligned edges of the striker plates 18. Because the pieces 12 and 14 are cut from steel stock in a stamping operation, the edges which form seam 214 can be slightly outwardly flared from the seam 214, which creates a trough in which the welding material pools and then crowns off to form the smooth convex latch pawl striking surface, which substantially improves the operation of the latch mechanism with the striker. The smooth cap weld reduces the amount of friction between the latch pawl and the striker bar, greatly improving the latch operation.

The mounting plates 16 each include at least one beveled fastener opening 32 configured to receive a fastener therethrough for securement of the striker assembly to a structure such as a car body door post. The striker assembly 10 is mounted to orient the striker bar 26 to face the opening of the latch mechanism housing.

Figure 5:
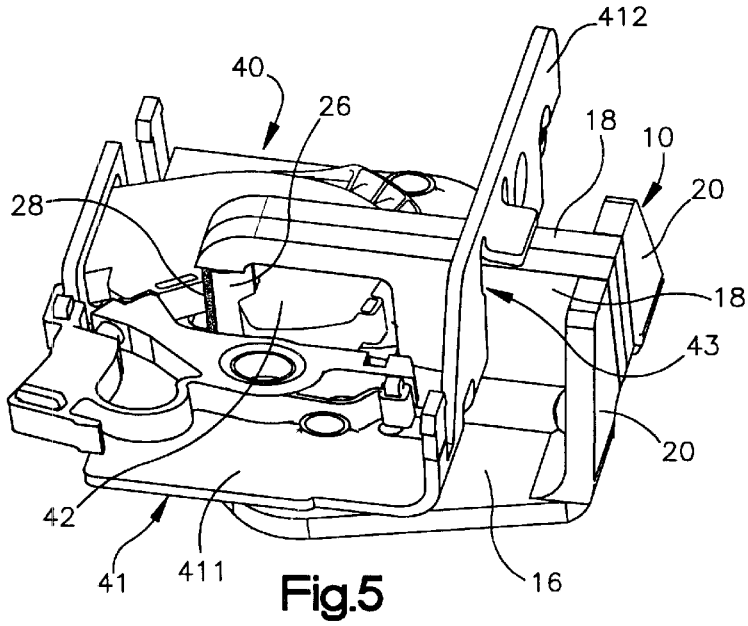
FIG. 5 is a different elevation of a striker assembly of the present invention engaged with a latching mechanism.
Figure 6:
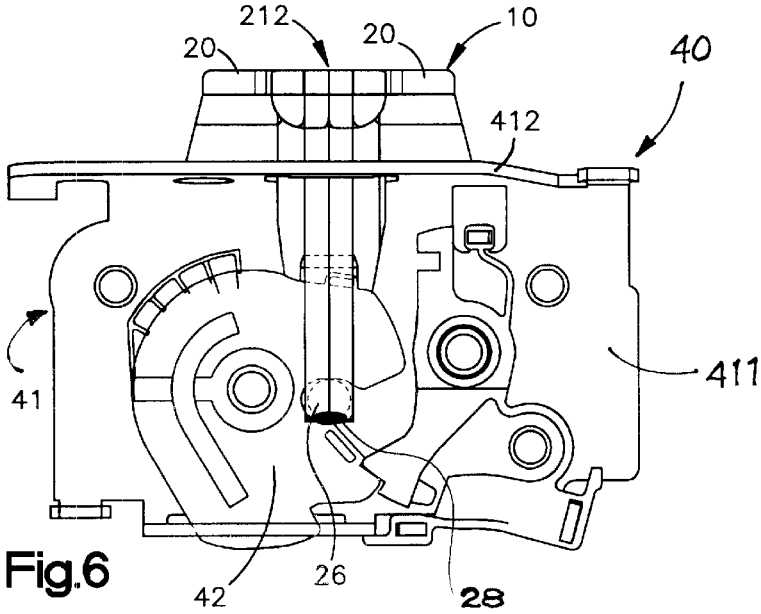
FIG. 6 is a plan view of the striker assembly and engaged latch of FIG. 5.
Figure 7:
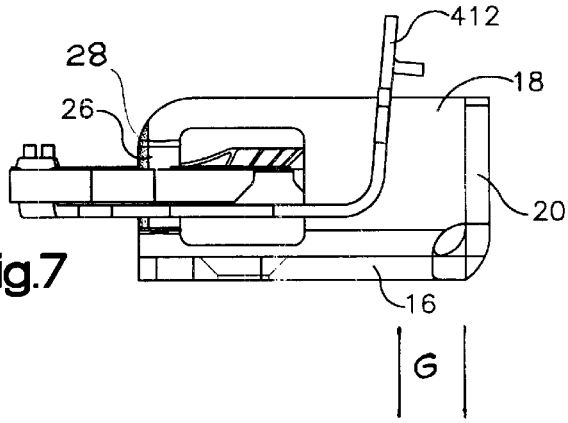
FIG. 7 is a profile view of the striker assembly and engaged latch of FIG. 5.

In operation, the closing of the vehicle door and the relative positioning of the striker assembly 10 on a door post causes the striker bar 26 to enter the latch housing opening and come into contact with the latch pawl 42 of a latch mechanism 40, as shown in FIGS. 5–7. The latch mechanism 40 includes a housing 41 with a striker receiving opening 43 configured and aligned to allow passage of the striker bar 26 into engagement with the latch pawl 42. Upon entering the striker receiving opening 43, the contact face of the striker bar cap weld 28 contacts the spring biased rotationally mounted pawl 42 and, upon further closing of the door, causes the pawl to rotate into engagement about the striker bar. The pawl of the locking mechanism will remain engaged with the striker assembly 10 until released by operation of the latch mechanism which causes the pawl to rotate out of engagement with the striker bar 26.

In this embodiment, the latch housing 41 is shown generally as a two plane structure, having a first plane 411 generally parallel to the mounting plates 16, and a second plane 412 generally parallel to the back plates 20. The striker receiving opening 43 is generally in the second plane 412. Other types of latch housings may be differently configured, but with the common design characteristics of the striker receiving opening, and a wall or plane which faces the back plates 20 of the striker assembly. The gap G between the back plates 20 and plane 412 is the designed clearance between the latch housing and the striker assembly in engagement. Under the forces of a crash this gap can be closed, with the striker bar 26 moving further into the latch mechanism, or the striker being "consumed" by the latch mechanism, making disengagement much more difficult. The back plates 20, in addition to substantially strengthening the entire striker assembly, limit this convergence and consumption to the extent of gap G. This greatly improves the latch strength and crash worthiness of the vehicle, making disengagement of the latch from the striker more likely by preventing consumption of the striker by the latch. The back plates 20 also serve as overslam protection against the latch mouth traveling too far into the striker bar 28 when the door is slammed with excessive force.

Figure 8:
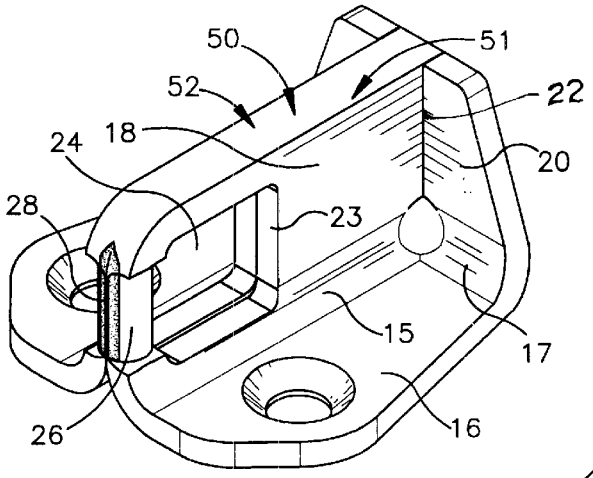
FIG. 8 is a perspective view of an alternate embodiment of the striker assembly of the invention.
Figure 9:
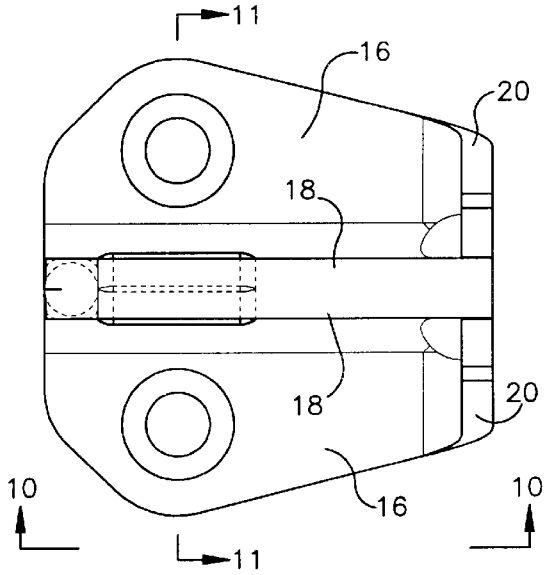
FIG. 9 is a plan view of the striker assembly of FIG. 8.
Figure 11:
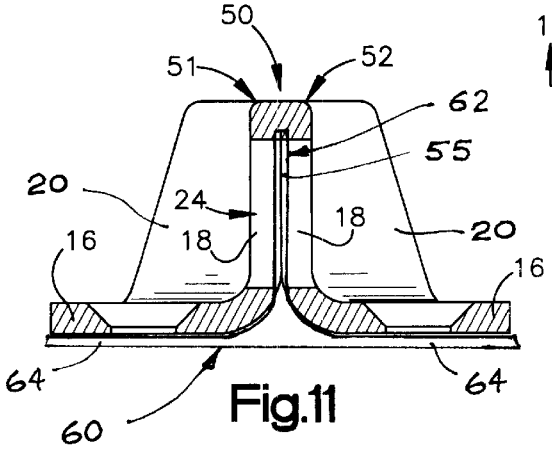
FIG. 11 is a different elevation of the striker assembly of FIG. 8.
Figure 10:
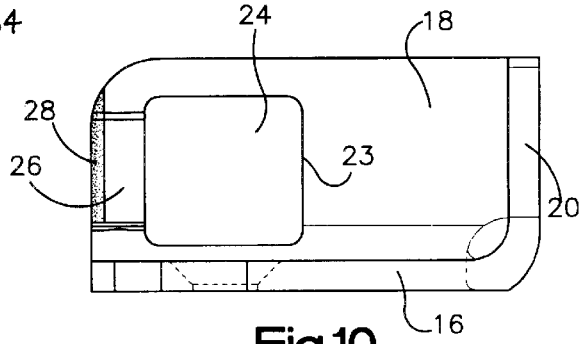
FIG. 10 is an elevation of the striker assembly of FIG. 8.

FIG. 8 illustrates an alternate embodiment of the striker assembly 10, formed from a single piece of stamped steel. The back-to-back striker plates 18 are joined at the top by a U-shaped bend 50 (thereby eliminating seam 211 described with reference to FIG. 1). Bend 50 may actually be formed as two closely spaced side-by-side bends 51, 52, as shown in FIG. 11, which may be necessary in the use of thicker gauge steel sheet stock as preferred. In a related method of manufacture, the single piece is die cut with the periphery of each of the plates 16, 18 and 20 in a common plane. Throat apertures 24 are also die cut at the periphery 23, and thereby forming the symmetrical halves of the striker bar 26. Bend 50 (or bends 51 and 52) are then formed, bringing the striker plates 18 and striker bar halves into the back-to-back arrangement. Bends 15 at the intersection of plates 16 and 18 are then formed, placing the mounting plates 16 at right angles to the respective striker plates 18. The back plates 20 extend from mounting plates 16, and are then formed perpendicular with the mounting plates along bends 17, to intersect the edge of the striker plates 18 opposite the striker bar 26 along seams 22. Welds are then made at the seams 22 between the back plates 20 and the striker plates 18. The cap weld 28 is formed over seam 214 at the contact face of the striker bar.

In the use of thicker gauge steel, such as high-strength low-alloy (HSLA) steel, e.g. SAE 1050 or SAE 1065, the bends 51 and 52 will form a gap 55 between the interior surfaces of parallel striker plates 18. Heat treating of the completed strikers of each embodiment is preferred to increase the structural strength of the part. As shown in FIG. 11, an insert piece 60, preferably made of plastic or other suitable polymer, is configured with a flange 62 which projects into and fills the gap 55, thus preventing moisture and corrosion in the gap. Further, the insert piece 60 may include mounting pads 64 which extend over the area of mounting plates 16 to provide a non-metallic mounting surface for the striker assembly. The mounting pads 64 deter corrosion between the mounting plates 16 and the mounting surface of a door post or other structure, and dampen vibration between the striker and the mounting surface.

Figure 12:
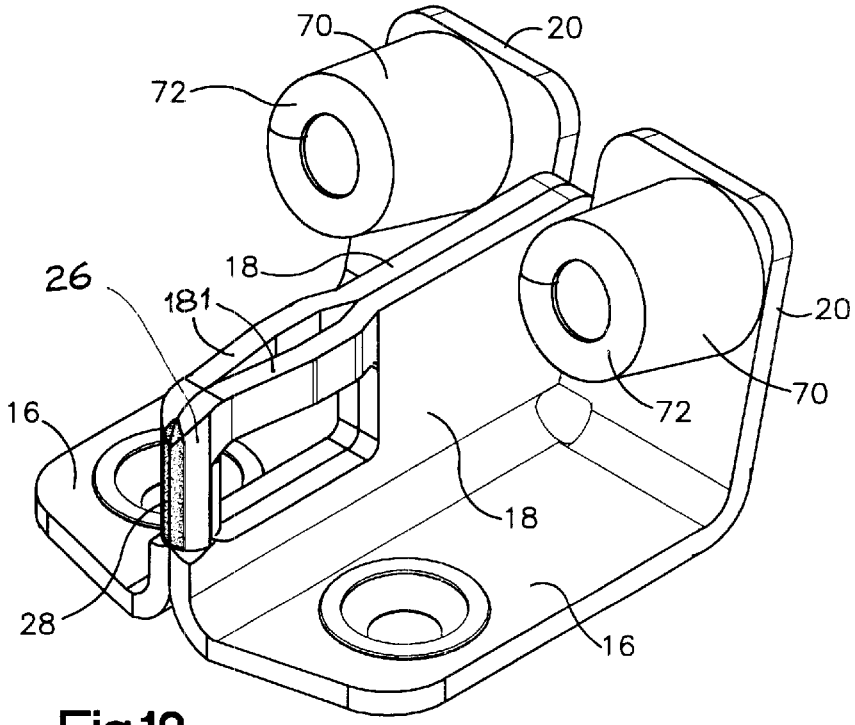
FIG. 12 is a perspective view of an alternate embodiment of a striker assembly of the invention.

FIG. 12 illustrates an alternate embodiment of the striker assembly of the invention, incorporating bumpers 70 into the design for contact with a facing wall of a latch housing or door on which a latch mechanism is mounted. In this particular form, the bumpers 70 are generally cylindrical or conical, and axially mounted on the sides of the back plates 20 facing the striker bar 26. This mounting can be accomplished by fasteners which extend axially through the bumper, or by "Christmas tree" push-in type fasteners formed integrally with the bumper body, and which extend into corresponding holes in the back plates 20. The body of each bumper 70 has a length designed so that a contact surface 72 is positioned for slight compressive contact with a facing surface or wall of a structure such as a door interior on which a latch mechanism (which engages with the striker) is mounted, or alternatively slightly out of contact for over-slam protection. The bumpers also substantially reduce noise or vibration between the striker assembly and the cooperating latch/door structure. Alternatively or additionally, one or more sensors may be mounted in the position of one or both of the bumpers 70, operative to indicate the presence of the door in the closed position, or more accurately, that status of the latch in a fully engaged condition with the striker. Such sensors may be of the optical or piezoelectric type.

Figure 13:
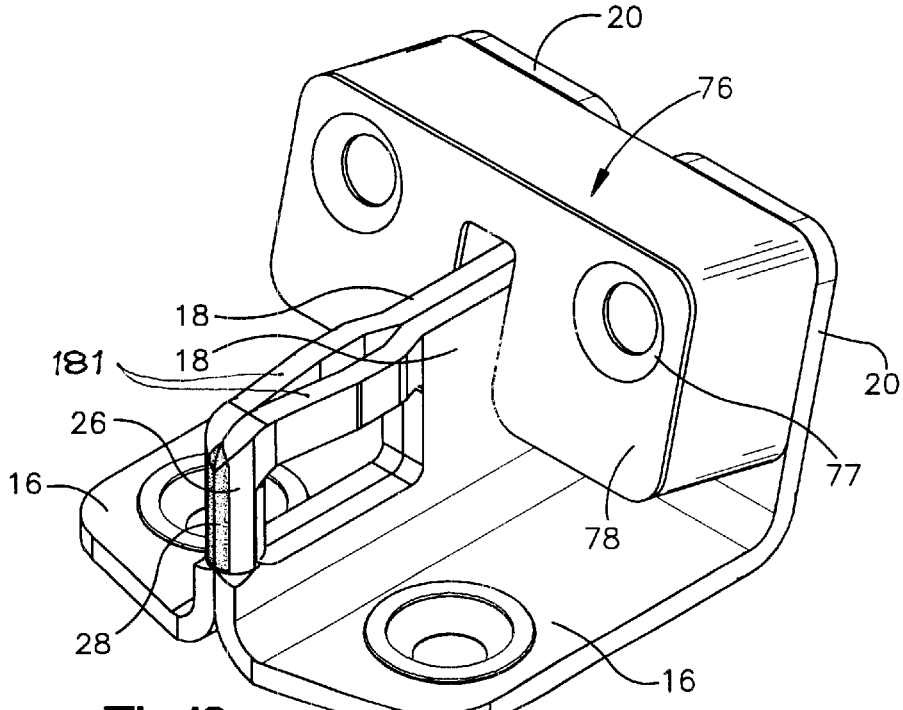
FIG. 13 is a perspective view of an alternate embodiment of a striker assembly of the invention.

FIG. 13 shows a different type of bumper 76, made in a unibody form, which is also mounted to the back plates through fastener holes 77, and which straddles the edges of the back-to-back striker plates. The unibody bumper 76 has a larger contact area 78 for increased dampening effect and/or over-slam protection with a contacting surface of a latch-carrying door.

As also shown in FIGS. 12 and 13, straps 181 of the striker plates 18 which extend across the opening 24 to the striker bar 26, may be slightly spread apart in the form of a wedge, or each strap having a convex arch which corresponds to an interior surface of the cooperating latch assembly. When in the form of a wedge, this part of the striker prevents the latch from "chucking" or moving relative to the axis of engagement, e.g. within the fish mouth of the latch. An arcuate bulge or curve in either strap facilitates slight rotational displacement of the latch relative to the striker in the normal load flexing of the car frame under use.

Although the invention has been shown and described with respect to a certain preferred embodiment, it is obvious that equivalent alterations and modifications will occur to others skilled in the art upon the reading and understanding of this specification. For example, the invention is not limited to the generally orthogonal arrangement of the intersecting plates of the striker assembly. Other forms of interconnection between the intersecting plates may be employed to provide a latch striker with an integral backplate. The present invention includes all such equivalent alterations and modifications and is limited only by the scope of the following claims.

What is claimed is:

1. A one piece striker assembly configured for mounting to a supporting structure and for engagement with a latch mechanism, the striker assembly comprising:

a first mounting plate connected through a radiused bend to a first striker plate, a second striker plate in parallel alignment with the first striker plate and connected to the first striker plate through at least one bend along an edge generally opposite the first mounting plate, aligned openings in each of the striker plates defining a double thickness striker bar along an edge of the first and second striker plates;

a second mounting plate attached to the second striker plate at an edge generally opposite to the connection to the first striker plate;

a first back plate which extends from an edge of the first mounting plate generally aligned with an edge of the first striker plate, and a second back plate which extends from an edge of the second mounting plate generally aligned with an edge of the second striker plate; the first back plate being connected to the first mounting plate through a radiused bend, and a proximate edge of the first back plate generally aligned with an edge of the first striker plate generally opposite the striker bar, the second back plate being connected to the first mounting plate through a radiused bend, and a proximate edge of the second back plate generally aligned with an edge of the second striker plate generally opposite the striker bar.

2. One piece striker assembly of claim 1 further comprising a cap weld along a seam created by aligned edges of the first and second striker plates which form the striker bar.

3. One piece striker assembly of claim 1 wherein edges of the first and second striker plates are bonded together.

4. The one piece striker assembly of claim 1 further comprising a bond between an edge of the back plate and the corresponding striker plate.

5. The one piece striker assembly of claim 1 further comprising two bends between the first and second striker plates.

6. The one piece striker assembly of claim 1 further comprising an insert piece between the first and second striker plates.

7. The one piece striker assembly of claim 1 in combination with a mounting piece which substantially covers mounting surfaces of the first and second mounting plates.

8. The one piece striker assembly of claim 1 further comprising an insert piece which fits between the first and second mounting plates and extends over mounting surfaces of the first and second mounting plates.

9. A striker for mounting to a support structure and engaging with a latch mechanism, the striker comprising:

a mounting surface defined by at least one mounting plate;

a striker plate attached to the mounting plate, the striker plate having an opening and a striker bar proximate to the opening, the striker bar being configured for engagement with a latch mechanism;

a back plate which intersects the mounting plate and the striker plate, the back plate in a plane spaced from the striker bar and located on opposite sides of the striker plate.

10. The striker of claim 9 wherein the striker plate and striker bar is a double layer thickness.

11. The striker of claim 9 wherein the mounting plate extends from the striker plate through a radiused bend.

12. The striker of claim 9 wherein the back plate extends from the mounting plate through a radiused bend.

13. The striker of claim 9 wherein the mounting plate, striker plate and back plate lie in the three intersecting planes.

14. The striker of claim 9 further comprising a cap weld over a contact surface of the striker bar.

15. The striker of claim 14 wherein the cap weld forms a crowned contact surface on the striker bar.

16. The striker of claim 9 wherein the cap weld extends over substantially all of the contact surface of the striker bar.

17. The striker of claim 9 in combination with at least one insert piece mounted on the back plate.

18. A striker for engaging a latch pawl of a latch mechanism by entry of a striker bar through an opening in a housing of the latch mechanism into contact with the latch pawl, the striker comprising:

a striker plate having a throat and a striker bar proximate to the throat, the striker plate and striker bar being oriented in alignment with an opening in a housing of a cooperating latch mechanism, a mounting plate connected to the striker plate and in a different plane than the striker plate, and a back plate which intersects the mounting plate and the striker plate in a plane spaced from the striker bar and on opposite sides of the striker plate.

19. The striker of claim 18 wherein the back plate is spaced from the striker bar a distance greater than a length of a striker receiving opening in a housing of a latch mechanism.

20. The striker of claim 18 further comprising an insert piece which fits between the back plate and a housing of a latch mechanism engaged with the striker.

* * * * *